United States Patent [19]

Stroud

[11] Patent Number: 4,793,390

[45] Date of Patent: Dec. 27, 1988

[54] HEADRIG SLABBING HEAD

[75] Inventor: Brian T. Stroud, Richmond, Canada

[73] Assignee: CAE Machinery, Vancouver, Canada

[21] Appl. No.: 162,913

[22] Filed: Mar. 2, 1988

[51] Int. Cl.[4] ..... B27C 9/00

[52] U.S. Cl. ..... 144/39; 144/220; 144/235

[58] Field of Search ..... 144/3 R, 39, 176, 218, 144/220, 223, 235, 236

[56] References Cited

U.S. PATENT DOCUMENTS 4,266,584 5/1981 Lomnicki ..... 144/235

4,340,099 7/1982 Lomnicki et al. ..... 144/220

*Primary Examiner*—W. Donald Bray

*Attorney, Agent, or Firm*—Townsend and Townsend

[57] ABSTRACT

A headrig slabbing head for machining a face on a log comprising a movable base platform mounted on rails to allow for varying the position of the base platform which supports a guide system having a carriage member adapted for movement along the guide system. A chipping head driven by a motor is mounted to the carriage member for cutting a face on a log. The position of the carriage member on the guide system can be varied to allow the chipping head to be adjusted to machine a face on logs of different diameters.

12 Claims, 3 Drawing Sheets

HEADRIG SLABBING HEAD

FIELD OF THE INVENTION

This invention relates to an adjustable apparatus for cutting a face on logs of various diameters.

BACKGROUND OF THE INVENTION

Headrig slabbing heads are used extensively throughout the world. The conventional practice is to mount a log to be sawn on a reciprocating carriage and feed the log past a headrig slabbing head which cuts a face on the log prior to the log being fed past the band saw of a headrig bandmill. The bandmill makes a second cut parallel to the newly cut face to create a board in one pass of the reciprocating carriage. Significant time savings result by making two cuts in one pass. As well, the slabbing head produces good quality wood chips that ca be used in paper making.

With existing headrig slabbing units, a slabbing head has to be sized to cut the largest diameter log. A slabbing head has an optimum chipping height with respect to the log to produce correctly sized chips and a uniform cut face. A very large slabbing head cutting on a small log will be operating outside this optimum chip height and will therefore produce poor quality chips and a poor quality surface. Typically, when processing a batch of logs, the average log diameter is about one third the diameter of the largest log, therefore a very large slabbing head is usually working on logs of less than optimum diameter. Additionally, large slabbing heads are obviously more expensive than smaller ones as they have more knives which require more maintenance.

SUMMARY OF THE INVENTION

The present invention is a headrig slabbing head that overcomes the disadvantages of the prior art by using a relatively small slabbing head that can be moved in a vertical plane to adjust to different diameter logs while maintaining optimum chipping performance.

Accordingly, the present invention is a headrig slabbing head for machining a face on a log comprising:

a movable base platform with means to vary the position of said base platform;

guide means extending from said movable base platform that support a carriage member adapted for movement along said guide means;

cutting mean mounted to said carriage member for cutting a face on a log;

driving means to drive said cutting means; and means to vary the position of said carriage member on said guide means whereby said cutting means can be adjusted to machine a face on logs of different diameters.

BRIEF DESCRIPTION OF THE DRAWINGS

A preferred embodiment of the present invention is shown in the accompanying drawings in which.

DESCRIPTION OF THE PREFERRED EMBODIMENT

Figure 1:
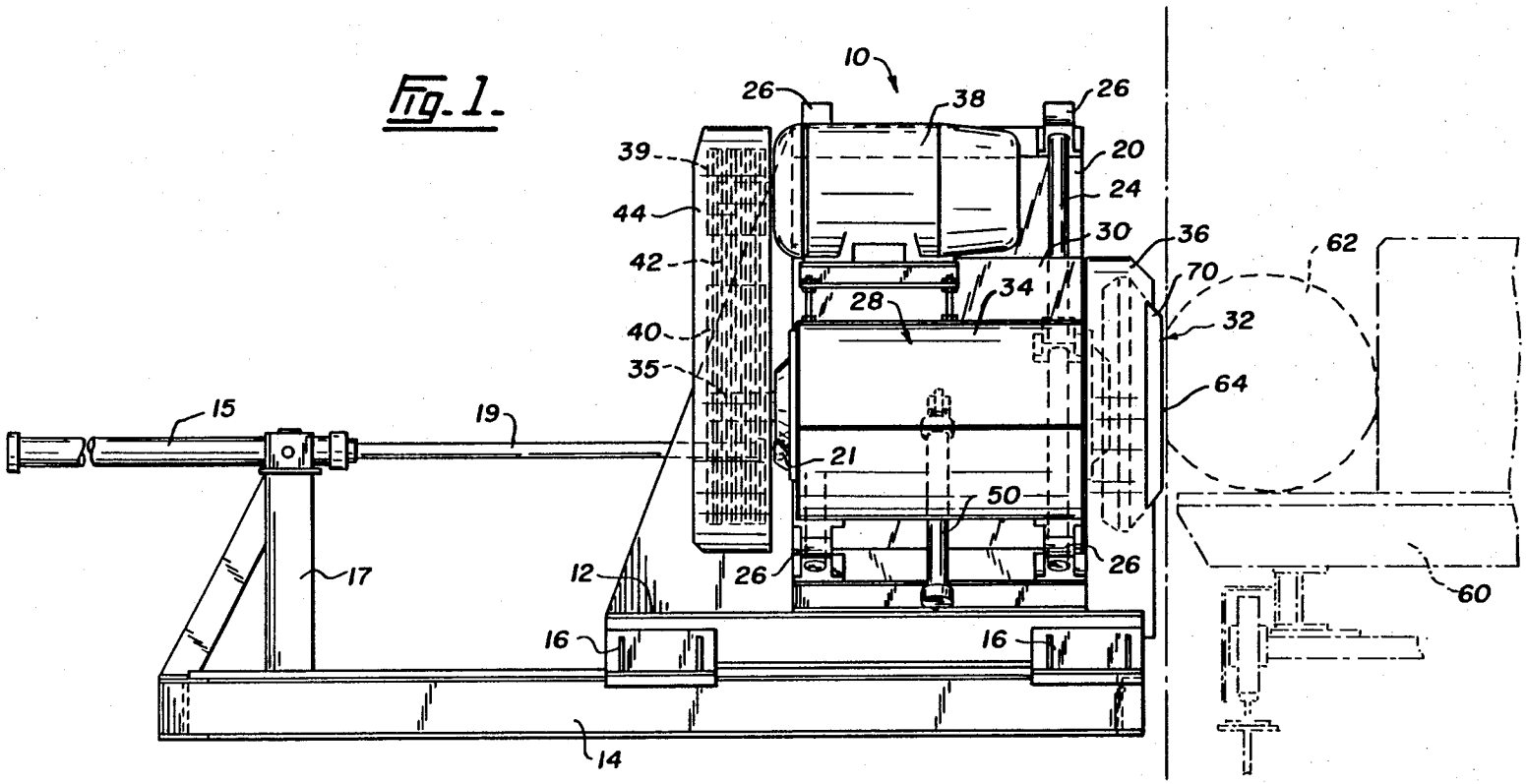
FIG. 1 is an side view of a headrig slabbing head according to the present invention.
Figure 2:
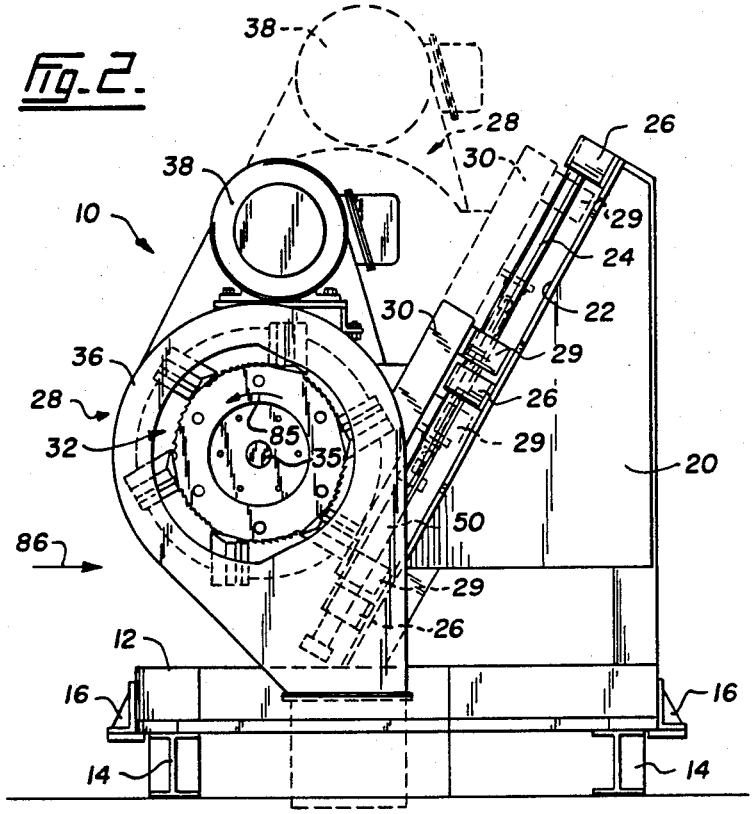
FIG. 2 is a front view of the apparatus of FIG. 1.

Referring to FIGS. 1 and 2, there is shown a headrig slabbing head 10 according to a preferred embodiment of the present invention. The device comprises movable base platform 12 that is slidable along a pair of spaced parallel rails 14 anchored firmly to the floor. Movable base 12 is supported on rails 14 by feet 16 at each corner of the essentially rectangular base. Means to move movable base platform 12 comprise a hydraulic cylinder 15 rigidly supported in framework 17 that is in turn rigidly attached to rails 14. Piston shaft 19 of cylinder 15 extends from the cylinder and is connected at joint 21 to support structure 20 that extends upwardly from movable base platform 12. By moving piston shaft 19 within cylinder 15 by hydraulic pressure, movable base 12 can be pushed and pulled along guide rails 14 to accurately positioned the base as desired. While base platform 12 is shown movable in a horizontal plane in the present embodiment, it is understood that movable base 12 is not limited to movement in a horizontal plane. By inclining guide rails 14, base platform 12 can also operate on an inclined plane. In the illustrated embodiment support structure 20 has an essentially triangular cross-section as viewed in FIG. 2. On inclined face 22 of support structure 20, guide means comprising a pair of spaced parallel shafts 24 are mounted. Each shaft 24 is held in place by three mounting brackets 26, one at each end of the shaft and the third midway along the shaft's length. While the present embodiment shows a support structure having an inclined face with inclined shafts 24, it is understood that the shafts 24 can also be mounted in a vertical manner on a suitably shaped support structure.

Shafts 24 slidably support carriage member 28. As best shown in FIG. 2, carriage member 28 is attached to shafts 24 by mounting blocks 29 extending from bed plate 30 of carriage member 28. Mounting blocks 29 have an aperture therethrough through which shaft 24 passes. Shaft 24 and the aperture in mounting block 29 are suitably dimensioned and lubricated so as to allow smooth motion of the mounting blocks 29 over the shafts 24. Bed plate 30 is positioned on shafts 24 so that mounting blocks 29 straddle the middle mounting bracket 26. Carriage member 28 is moved along shafts 24 by means of hydraulic cylinder 50 located between shafts 24 and aligned parallel with the shaft' longitudinal axes, as best shown in FIG. 1. One end of the cylinder 50 is connected to support structure 20 and the opposite end is connected to carriage member 28. By extending or retracting the piston shaft of cylinder 50, carriage member 28 and its attached equipment is movable between a lowered position and an upper position as shown by dashed lines in FIG. 2. In the event of hydraulic cylinder 50 failing, mounting blocks 29 engaging against middle and lower mounting brackets 26 will arrest the motion of carriage member 28 as it slides down shafts 24 under its own weight.

Extending from bed plate 30 of carriage member 28 is a cutting means comprising chipping or slabbing head 32 rotatably mounted in bearing assembly 34. Chipping head 32 is mounted at one end of rotatable shaft 35 for rotation therewith and extends outwardly from that end of carriage member 28 that is opposite the end adjacent joint 21 connecting hydraulic cylinder piston shaft 19 and support structure 20. The axis of rotatable shaft 35 is parallel to the longitudinal axes of guide rails 14.

Chipping head 32 is surrounded by cowling 36 which is shaped to collect and direct chips produced by the chipping head downwardly to the floor and into a chip chute (not shown).

Mounted above bearing assembly 34 is the drive means for rotating chipping head 32 comprising an electric motor 38 with belt wheel 39 attached to the motor's output shaft. As best shown in FIG. 1, motor 38 is positioned such that belt wheel 39 lies directly above belt wheel 40 attached to the end of rotatable shaft 35 opposite chipping head 32. Belt wheels 39 and 40 are connected by belt 42 which transmits the rotary motion of motor 38 to shaft 35 and hence chipping head 32. Belt wheels 39 and 40 are sized so that electric motor 38 rotates chipping head 32 at its optimal speed for producing good quality chips. As a safety precaution, cowling 44 is fitted over pulleys 39 and 40.

Figures 4A, 4B, 4C:
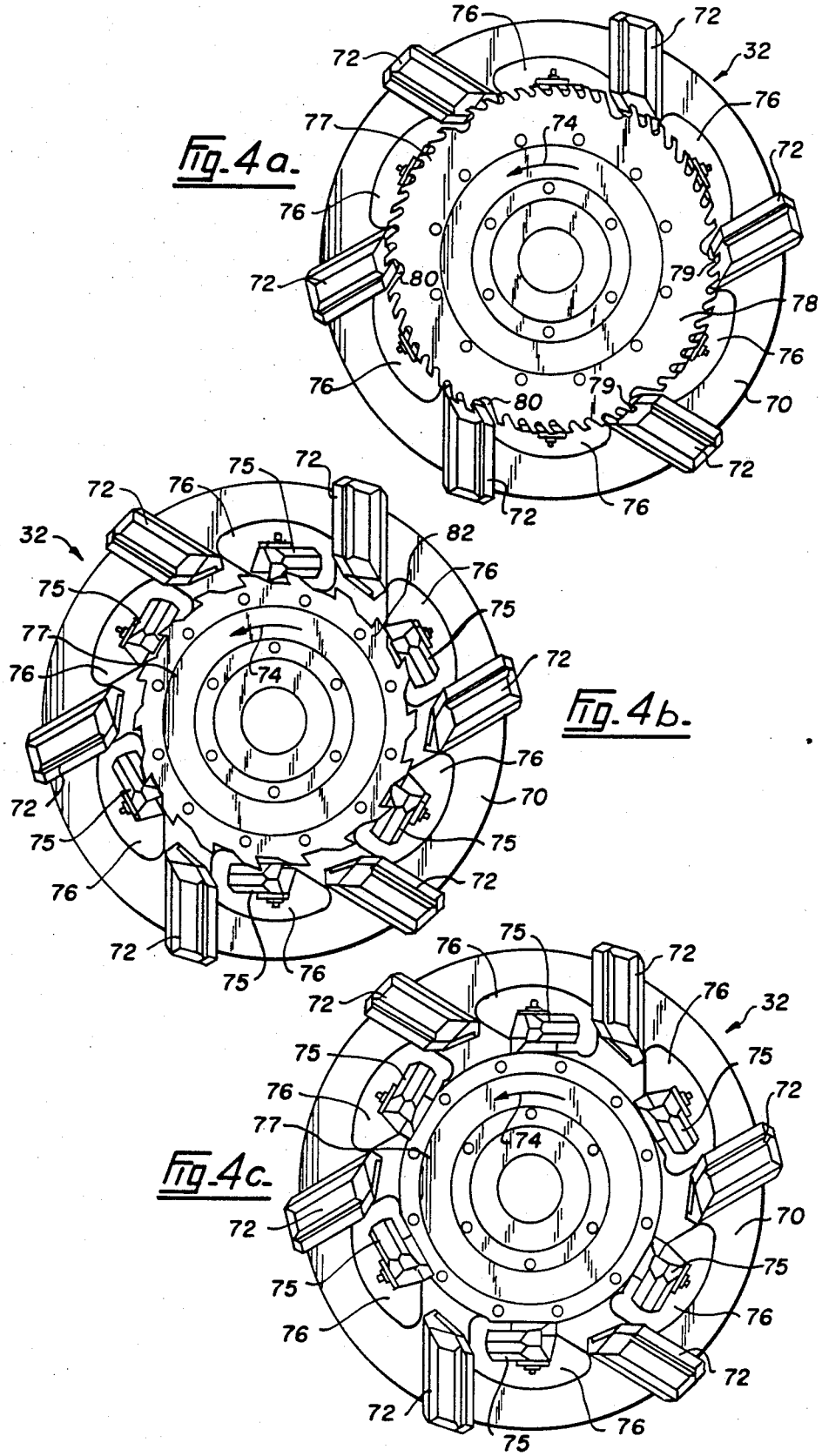
FIGS. 4*a*–4*c* show various cutting surfaces of the slabbing head.

Examples of various chipping heads 32 for use with the headrig slabbing head of the present invention are shown in FIGS. 4*a*, 4*b* 4*c*. As the side view of FIG. 1 best indicates, chipping head 32 comprises an essentially frusto-conical casting 70 to which the various cutting implements of the chipping head are mounted. FIGS. 4*a*, 4*b* and 4*c* provide a front view of casting 70. About the sloping sides of casting 70, a plurality of regularly spaced conventional chipping knives 72 are positioned so as to define a cutting plane parallel to face 77 at the narrowed end of casting 70. In this cutting plane, chips are cut from the face of a log moved past the chipping head 32 when the head is rotating in the counterclockwise direction indicated by arrow 74. In addition, if desired, a plurality of conventional planing knives 75 can be positioned in cavities 76 in the sloping sides of casting 70. Such planing knives 75 extend into the same cutting plane as the chipping knives. End face 77 of casting 70 is used to mount the chipping head 32 to rotatable shaft 35, and also serves to mount various auxiliary cutting implements depending on the condition of the log to be cut.

FIG. 4*a* shows a chipping head 32 equipped with a saw blade 78 mounted to the end face 77. Planing knives are not used with this particular chipping head. Saw blade 78 lies in the same cutting plane as chipping knives 7 and where the teeth of the blade would overlap the leading cutting edge 79 of a chipping knife, the teeth are removed as at 80. It has been found that such a chipping head arrangement provides the best surface finish on the cut face of the log and works best with non-frozen wood.

FIG. 4*b* shows a chipping head 32 equipped with a cutter disc 82 lying in the same cutting plane as the chipping 72 and planing 75 knives. Such an arrangement has been found to be best suited for opening a face on frozen wood or hardwoods.

FIG. 4*c* shows a chipping head 32 equipped with planing knives 72 and end face 77 left uncovered. This arrangement has been found to provide maximum chip recovery.

Referring to FIG. 1, the manner in which the present invention is positioned with respect to a conventional log carriage 60 is shown. The log carriage 60 holds and supports a log 62 and moves the log past the rotating chipping head 32 of the headrig slabbing head of the present invention so that a face 64 is machined on the log and in so doing chipping head 32 produces good quality chips suitable for paper making. Just past the headrig slabbing head, the band saw of a bandmill (not shown) makes a second cut in the log parallel and offset from the machined face 64 so that a board section is created in one pass of the log carriage. The log carriage and log are then returned to their initial position. The log is turned and another pass is made past the headrig slabbing head of the present invention in order to open another face on the log. The process is repeated to open two, three or four faces on the log depending on the size of the log. Arrow 86 in FIG. 2 indicates the direction which a log is moved past the apparatus of the present invention when a face is cut on the log while arrow 85 indicates the direction of rotation of chipping head 32. Alternatively, chipping head 32 could be set up to operate in the opposite direction of rotation if such an arrangement better suited the particular installation site. Once the required faces have been cut on the log, the headrig slabbing head of the present invention is no longer used and subsequent cutting of the log is done by the bandmill alone.

Figure 3:
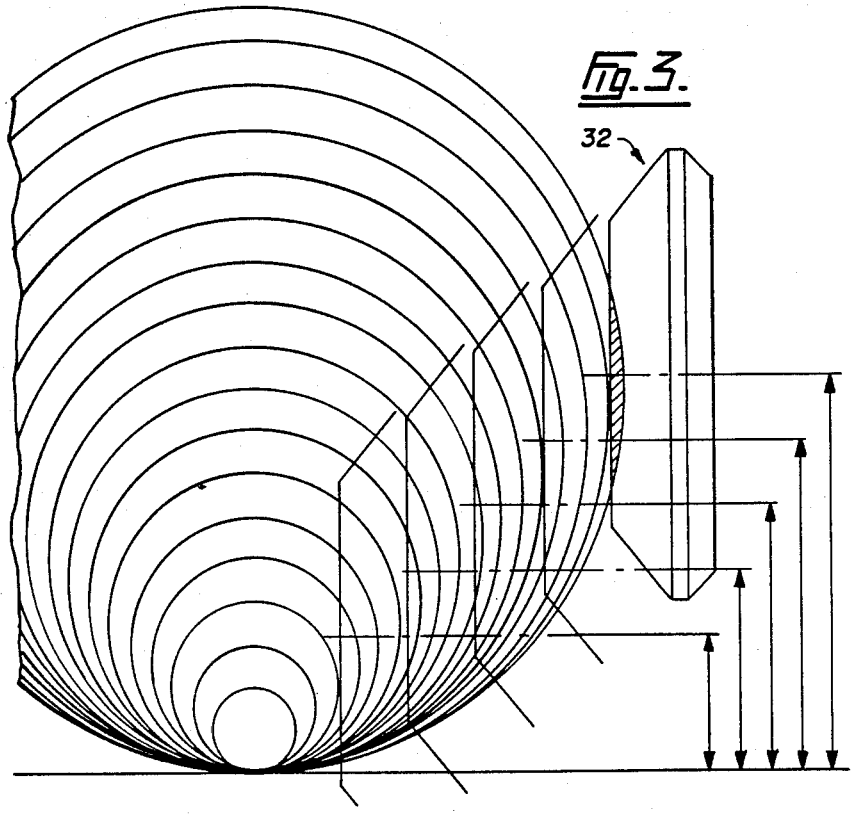
FIG. 3 shows the adjustable nature of the slabbing head of the present apparatus.

FIG. 3 shows how the apparatus of the present invention can be used to machine a face on a wide range of log diameters using the same size chipping head 32, thereby eliminating the need for larger chipping heads that are costlier and generally require more maintenance. On smaller logs, carriage member 28 is lowered on shafts 24 to lower chipping head 32 for contact with the log surface. As well, movable base platform 12 is advanced toward the log using hydraulic cylinder 15. For larger diameter logs, chipping head 32 is raised on carriage 28 and base platform 28 is retreated along rails 14 to ensure that chipping head 32 always contacts the log surface in a manner that produces good quality chips. Preferably, the vertical position of the carriage member 28 and the horizontal position of the base platform 12 are set by information received from the log carriage setworks prior to chipping.

In FIG. 3, five set positions for chipping head 32 are shown. At each set position, the chipping head remains at a constant height above a reference line measured from the base of the log. By moving the chipping head 32 in a horizontal direction at each set position, the headrig slabbing apparatus of the present invention is able to machine a face on a range of log sizes with good quality chip production throughout the range. By moving the chipping head to new set position, a different range of log sizes can be processed while still maintaining good chip quality.

I claim:

1. A headrig slabbing head for machining a face on a log comprising:

a movable base platform with means to vary the position of said base platform;

guide means extending from said movable base platform that support a carriage member adapted for movement along said guide means;

cutting means mounted to said carriage member for cutting a face on a log;

driving means to drive said cutting means; and means to vary the position of said carriage member on said guide means whereby said cutting means can be adjusted to machine a face on logs of different diameters.

2. A headrig slabbing head as claimed in claim 1 in which said movable base platform moves in an essentially horizontal plane and said carriage member moves in an essentially vertical plane.

3. A headrig slabbing head as claimed in claim 1 in which said guide means comprise a set of essentially vertical shafts upon which said carriage member is slidably mounted.

4. A headrig slabbing head as claimed in claim 1 in which said cutting means comprises a chipping head assembly rotatably mounted to said carriage member having a plurality of chipping knives mounted about said chipping head for cutting a face on a log.

5. A headrig slabbing head as claimed in claim 4 in which said chipping head assembly includes a second cutting means mounted in the same plane as said chipping knives.

6. A headrig slabbing head as claimed in claim 5 in which said second cutting means comprises a set of planing knives.

7. A headrig slabbing head as claimed in claim 5 in which said second cutting means comprises a conventional saw blade.

8. A headrig slabbing head as claimed in claim 5 in which said second cutting means comprises a conventional cutter disc.

9. A headrig slabbing head as claimed in claim 1 in which said driving means is mounted to and movable with said carriage member.

10. A headrig slabbing head as claimed in claim 1 in which said driving means comprises an electric motor for rotating said cutting means.

11. A headrig slabbing head as claimed in claim 1 in which said movable base platform is mounted on parallel rails and said means to vary the position of said movable platform comprises a hydraulic cylinder mounted to said parallel rails, the piston of said hydraulic cylinder being connected to said movable base platform such that as said piston is extended or retracted said movable base platform is moved along said parallel rails.

12. A headrig slabbing head as claimed in claim 1 in which said means to vary the position of said carriage member on said guide means comprises a hydraulic cylinder mounted between said base platform and said movable carriage such that as the piston of said hydraulic cylinder is extended or retracted said slidable carriage is moved along said guide means.

* * * * *